United States Patent [19]

Goan et al.

[11] Patent Number: 4,990,439

[45] Date of Patent: Feb. 5, 1991

[54] SILVER HALIDE LIGHT-SENSITIVE PHOTOGRAPHIC MATERIAL

[75] Inventors: Kazuyoshi Goan; Takuji Hasegawa, both of Tokyo, Japan

[73] Assignee: Konica Corporation, Tokyo, Japan

[21] Appl. No.: 388,167

[22] Filed: Aug. 1, 1989

[30] Foreign Application Priority Data

Aug. 3, 1988 [JP] Japan ..... 63-193928
Aug. 30, 1988 [JP] Japan ..... 63-217138

[51] Int. Cl.[5] ..... G03C 1/02; G03C 1/72

[52] U.S. Cl. ..... 430/569; 430/622; 430/628; 430/642

[58] Field of Search ..... 430/569, 628, 622, 642

[56] References Cited

U.S. PATENT DOCUMENTS 2,614,928 10/1952 Yutzy ..... 430/569
4,087,282 5/1978 Mitsui et al. ..... 430/569
4,173,481 11/1979 Sera et al. ..... 430/622

*Primary Examiner*—Paul R. Michl
*Assistant Examiner*—Thorl Chea
*Attorney, Agent, or Firm*—Jordan B. Bierman

[57] ABSTRACT

A silver halide light-sensitive photographic material having a support and provided thereon, hydrophlic colloidal layers including at least one silver halide light-sensitive emulsion layer is disclosed. The silver halide emulsion layer comprises a silver halide emulsion (I) prepared by adding a high-molecular flocculant under at least one of Conditions (1) through (3) to a silver halaide emulsion (II) prepared by a water-soluble silver salt solution and a water-soluble halide solution to a protevtive colloid solution so as to flocculate and settle a silver halide grain together with a protective colloid for desalting of dissolved substances, and by dispersing again the desalted silver halide emulsion in a protective colloid solution;

Condition (1): a temperature of the silver halide emulsion (II) is not lower than 30° C. in adding a high-molecular flocculant, Condition (2): pH and pAg of the silver halide emulsion (II) are not lower than 2 and not lower than 5, respectively, in adding a high-molecular flocculant, and Condition (3): a concentration of a silver halide grain contained in the silver halide emulsion (II) is not less than 20% by weight in adding a high-molecular flocculant.

13 Claims, No Drawings

SILVER HALIDE LIGHT-SENSITIVE PHOTOGRAPHIC MATERIAL

FIELD OF THE INVENTION

The present invention relates to a silver halide light-sensitive photographic material which is highly sensitive, rapidly processable and capable of forming a high-quality photographic image, and more particularly to a silver halide light-sensitive photographic material which, even when processed rapidly in an automatic processor, is less subjected to roller marking and provides a high-quality photographic image with an improved silver image tone.

BACKGROUND OF THE INVENTION

Silver halide light-sensitive photographic materials are strongly demanded to comprise high sensitivity and high quality. On the other hand, an increased consumption of the light-sensitive materials makes it indispensable to process them rapidly in a short time. Particularly, in the field of radiographic materials for medical use, rapid processing is required because of necessity for informing the diagnostic results to the patients as soon as possible, while a number of radiographed films has recently been increasing due to rapid increase of diagnostic frequency and examination items. Especially, in an angiography and an in-operation radiography, the radiographs are required to be checked without a moment's delay.

Under such circumstances, various attempts have ever been made to develop techniques for rapid processing: for example, in an image forming process, development was tried for acceleration of processing at high pH and temperature (30° to 40° C.). Such high pH and temperature, however, are liable to result in deteriorating photographic images. Particularly when processing in an automatic processor, the above conditions are liable to deteriorate a light-sensitive material's pressure resistance and result in deteriorating images due to so-called roller marks formed by pressure of transport rollers.

In radiography, deterioration of images possibly leads to an erroneous diagnosis.

In the case of an X-ray film, where a developed silver image is visually observed for diagnosis, its image quality, i.e., a tone of silver forming an image, graininess, resolution, and sharpness are very important factors.

From a diagnostic point of view, the tone of the developed silver affects that of the image, and a low density area corresponding to D=1.0 comprises most preferably a black tone free of stain tinged with red or yellow.

To these demands mentioned above, there have been a number of proposals such as improvement of physical properties or application of a toning agent. Any of these proposals, however, comprise possibility to affect the photographic characteristics of a light-sensitive material.

SUMMARY OF THE INVENTION

It is an object of the present invention to provide a silver halide light-sensitive photographic material comprising a high sensitivity and an excellent pressure resistance, and capable of giving an image having an excellent tone and free of deterioration by roller marks.

The above object of the present invention is accomplished by a silver halide light-sensitive photographic material (hereinafter referred to as the light sensitive material of the invention) having a support and provided thereon the hydrophilic colloidal layers including at least one silver halide light-sensitive emulsion layer, in which said silver halide emulsion layer contains a silver halide emulsion (I) prepared by adding a high-molecular flocculant under at least one of the following Conditions (1) through (3) to a silver halide emulsion (II) prepared by adding a water-soluble silver salt solution and a water-soluble halide solution to a protective colloid solution so as to flocuulate and settle a silver halide grain contained in the silver halide emulsion (II) together with a protective colloid for desalting of the dissolved substances, and by dispersing again the desalted silver halide emulsion in a protective colloid solution;

Condition (1): the temperature of the silver halide emulsion (II) is not lower than 30° C. in adding a high-molecular flocculant, Condition (2): pH and pAg of the silver halide emulsion (II) are not lower than 2 and not lower than 5, respectively, in adding a high-molecular flocculant, and Condition (3): the concentration of a silver halide grain in the silver halide emulsion (II) is not less than 20% by weight in adding a high-molecular flocculant.

DETAILED DESCRIPTION OF THE INVENTION

Generally, in the process of manufacturing a photographic silver halide emulsion, the silver halide emulsion is usually subjected to desalting to improve water-soluble salts such as excessive silver halides, alkali nitrate and ammonium salts after completion of physical ripening.

The desalting methods include a noodle method, a dialysis method, and a flocculation precipitation method. Of these methods, the flocculation precipitation method is extensively put into practical use since it is more excellent than the others.

The light-sensitive material of the invention is characterized by that at least one light-sensitive silver halide emulsion layer provided on a support and included in the hydrophilic colloidal layers contains a silver halide emulsion (I) prepared by adding a high-molecular flocculant under at least one of the foregoing Conditions (1) through (3) to a silver halide emulsion (II) prepared by adding a water-soluble silver salt solution and a water-soluble halide solution to a protective colloidal solution so as to flocculate and precipitate a silver halide grain together with a protective colloid for removing the dissolved salts. If at least any one of these Conditions (1) through (3) is satisfied, then an objective effect can be obtained. Preferably, two or more of these conditions are satisfied, and most preferably all the Conditions (1) through (3) are satisfied.

Condition (1) specifies that the temperature of the silver halide is not less than 30° C. in adding a high-molecular flocculant. The temperature is preferably 30° C. to 60° C.

Condition (2) specifies that pH and pAg of the silver halide emulsion is not lower than 2 and not lower than 5, respectively, in adding a high-molecular flocculant. Preferably, pH is 2 to 6, and pAg is not lower than 10 and not higher than 12.

Condition (3) specifies that the concentration of the silver halide grains in the emulsion is not less than 20% by weight in adding a high-molecular flocculant. This is preferably not less than 20% by weight and not more than 50% by weight.

Further, the hydrophilic colloidal layers are hardened preferably with a vinylsulfone type hardener.

The light-sensitive material of the invention has on a support the hydrophilic collidal layers including at least one silver halide emulsion layer, which means the light-sensitive material may be provided either on one side or both sides of the support with the silver halide emulsion layers.

The light-sensitive material of the invention contains the emulsion of the invention prepared under the preceding conditions.

The emulsion of the invention may be contained in at least one of the light-sensitive emulsion layers and preferably in all the light-sensitive emulsion layers. The emulsion of the invention may be used alone or in combination with the emulsions either of the invention or out of the invention.

The aforementioned protective colloidal solution contains preferably protective colloidal gelatin.

In the invention, gelatin used as a protective colloid may be treated by lime or acid. The details of preparation of gelatin is described in Arthur Vice, 'The Molecular Chemistry of Gelatin' (Academic Press, 1964).

The hydrophilic colloids usable as a protective colloid include a gelatin derivative, a graft polymer of gelatin with other polymer, protein such as albumin and casein; a cellulose derivative such as hydroxyethyl cellulose, carboxymethyl cellulose, and cellulose sulfate; a sugar derivative such as sodium alginate and a starch derivative; various kinds of synthetic hydrophilic homo- or copolymers such as polyvinyl alcohol, partially acetalized polyvinyl alcohol, poly-N-vinyl-pyrrolidone, polyacrylic acid, polymethacrylic acid, polyacrylamide, polyvinylimidazole, and polyvinylpyrazole.

It is preferable to use gelatin having a jelly strength of not less than 200 measured according to the PAGI method.

In the light-sensitive material of the invention, gelatin is preferably used as a hydrophilic colloid usable for such photographic component layers as a protective layer, a backing layer and an intermediate layer. The above hydrophilic colloids besides gelatin may also be used alone or in combination with gelatin.

In the invention, a high-polymer flocculant comprises a function to flocculate and settle a silver halide grain together with protective colloid. and expedites gelation of the protective colloid to remove easily the dissolved salts (desalting process).

In the present invention, various high-molecular flocculants can be used, and preferable one is represented by the following Formula (I):

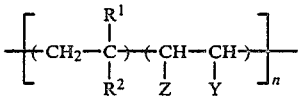

Formula (I)

wherein $R^1$ and $R^2$ independently represent an alkyl group having 1 to 8 carbon atoms; Z and Y each represent —COOM, —$COOR^3$ or

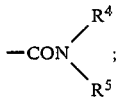

M represents a hydrogen atom, an alkali metal atom or an ammonium group; $R^3$ represents an alkyl group having 1 to 20 carbon atoms or an aryl group; $R^4$ and $R^5$ each represent a hydrogen atom, an alkyl group having 1 to 20 carbon atoms or an aryl group, provided that $R^4$ and $R^5$, may combine with each other to form a heterocyclic ring; and n is an integer of 10 to $10^4$.

In the invention, where a gelatin flocculant is used as a high-molecular flocculant. preferably used is a modified gelatin having the 50% or more substituted amino groups of the gelatin molecules. The examples of the substituent to the amino group are described in U.S. Pat. Nos. 2,691,582, 2,614,928 and 2,525,753.

Those useful substituents include:

(1) an acyl groups such as alkylacyl, arylacyl, acetyl and benzoyl,
(2) a carbamoyl groups such as alkylcarbamoyl and arylcarbamoyl,
(3) a sulfonyl groups such as alkylsulfonyl and arylsulfonyl,
(4) a thiocarbamoyl groups such as alkylthiocarbamoyl and arylthiocarbamoyl,
(5) a straight-chain or branched alkyl group having 1 to 18 carbon atoms, and
(6) an aryl group such as an aromatic heterocyclic group, phenyl and naphthyl.

The preferred one thereof is an acyl group (—$COR^1$) or a carbamoyl group

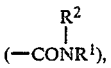

wherein $R^1$ represents an aliphatic group such as an alkyl or allyl group each having 1 to 18 carbon atoms, an aryl group or an aralkyl group such as phenethyl; and $R^2$ represents a hydrogen atom, an aliphatic group, an aryl group, or an aralkyl group.

Preferably, $R^1$ is an aryl group and $R^2$ is a hydrogen atom.

The examples of the gelatin flocculant usable as a high-molecular flocculant in the invention are shown below with the substituent to the amino group thereof:

Substituents to the amino group:

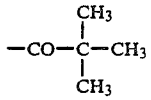

G-1

—$COCH_3$ G-2

G-3

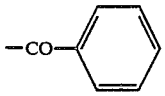

-continued

Substituents to the amino group:

G-4

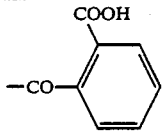

G-5

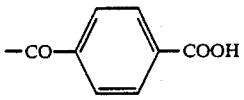

G-6

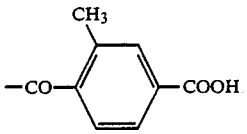

G-7

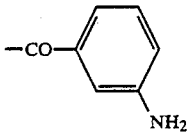

G-8

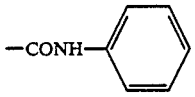

G-9

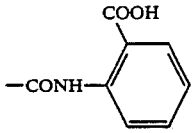

G-10

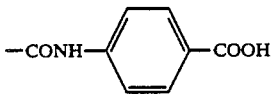

G-11

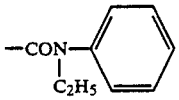

G-12

$-CONHCH_3$

An addition amount of the gelatin flocculant used for desalting is usually 0.3 to 10 parts by weight per part by weight of a protective colloid, and preferably 1 to 5 parts by weight.

After adding the gelatin flocculant, pH of the emulsion may be adjusted to expedite flocculation and precipitation of the silver halide grains, and the pH condition specified in the foregoing Condition (2) can be applied thereto, which will be explained again hereinafter. pH of the emulsion in adding the flocculant is preferably not higher than and more preferably 4.5 to 2. A suitable acid for use in adjusting pH includes an organic acid such as acetic acid, citric acid, and salicylic acid, or an inorganic acid such as hydrochloric acid, nitric acid, sulfuric acid, and phosphoric acid. In combination with the gelatin flocculant, heavy metal ions such as magnesium ions, cadmium ions, lead ions, and zirconium ions may be added.

Desalting may be carried out once or several times, and the gelatin flocculant may be added every desalting or only at first. The high molecular flocculant represented by Formula (I) comprises preferably a molecular weight of $10^3$ to $10^6$, and more preferably $3\times10^3$ to $2\times10^5$. An addition amount thereof is preferably 1/50 to $\frac{1}{4}$ by weight of a protective colloid contained in the emulsion, and more preferably 1/40 to 1/10. The manner of using these compounds is in accordance with that of the foregoing gelain flocculant.

The following are the examples of the high-molecular flocculant having Formula (I):

P-1

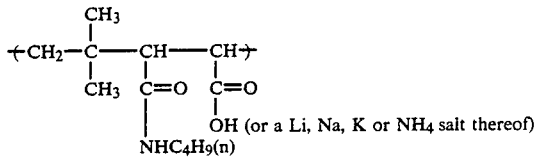

P-2

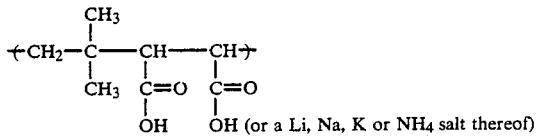

P-3

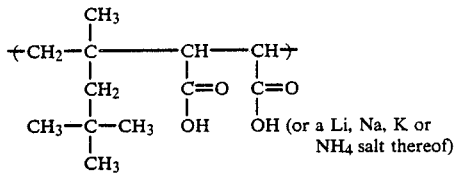

P-4

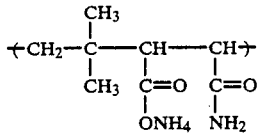

P-5

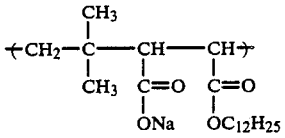

P-6

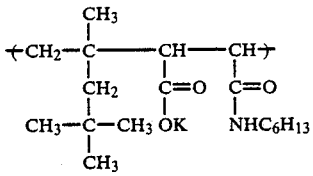

P-7

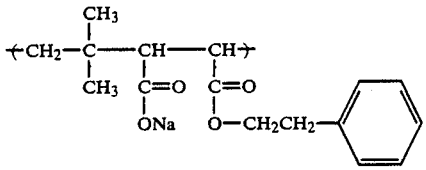

P-8

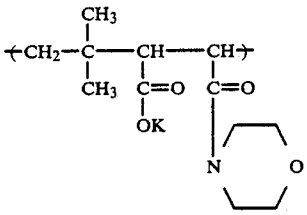

-continued

P-9

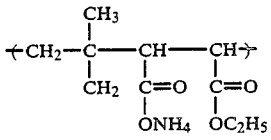

P-10

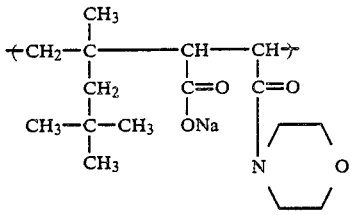

In the invention, the temperature of the silver halide emulsion is preferably not lower than 30° C. in adding the above high-molecular flocculant, in accordance with the foregoing Condition (1), and more preferably 30° to 60° C.

pH of the emulsion is preferably not lower than 2 in adding the above high-molecular flocculant, and more preferably 2 to 6. Also, pAg of the emulsion is preferably not lower than 5, and more preferably 10 to 12. pH and pAg are preferably 2 or more and 5 or more, respectively, in accordance with the foregoing Condition (2). pH and pAg can be set to the prescribed values by adjusting pH and pAg of the emulsion in a reactor. The aforementioned acids can be used to adjust pH.

An aqueous halide solution or an aqueous silver salt solution are used for pAg adjustment.

Also, according to the foregoing Condition (3), the concentration of the silver halide emulsion is preferably not less than 20% by weight in adding the above high-molecular flocculant, and more preferably 20 to 50% by weight. The concentration of the silver halide emulsion is a percentage by weight of the silver halide grains contained in the emulsion.

A vinylsulfone type hardener used in the invention may be any compound as long as it has at least two vinylsulfone groups in a molecule. Particularly, the compound useful for the invention is represented by the following Formula (II):

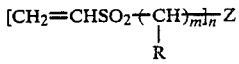

Formula (II)

wherein R represents a hydrogen atom or a lower alkyl group, preferably a hydrogen atom or a methyl group; Z represents an n-valent group having at least one of oxygen, nitrogen and sulfur atoms, and preferably an oxygen atom or a nitrogen atom; and m is an integer of 1 or 2, and n is an integer of 2 or 3.

The following are the examples of the compound having Formula (II):

$CH_2{=}CHSO_2CH_2OCH_2SO_2CH{=}CH_2$ H-1

$CH_2{=}CHSO_2CH_2CH_2CH_2CH_2OCH_2CH_2CH_2CH_2SO_2CH{=}CH_2$ H-2

$CH_2{=}CHSO_2CH_2CH_2OCH_2CH_2OCH_2CH_2SO_2CH{=}CH_2$ H-3

$CH_2{=}CHSO_2CH_2CH_2OCH_2CH_2NHCONHCH_2CH_2OCH_2CH_2SO_2CH{=}CH_2$ H-4

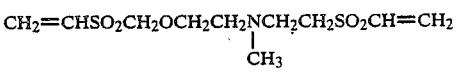

H-5

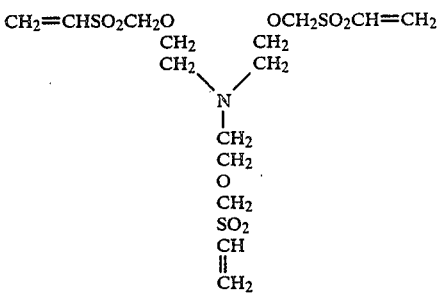

H-6

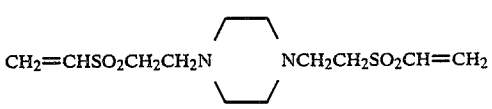

H-7

$CH_2{=}CHSO_2CH_2OCH_2CH_2SO_2CH_2CH_2OCH_2SO_2CH{=}CH_2$ H-8

$CH_2{=}CHSO_2CH_2SO_2CH{=}CH_2$ H-9

$CH_2{=}CHSO_2CH_2CH_2SO_2CH{=}CH_2$ H-10

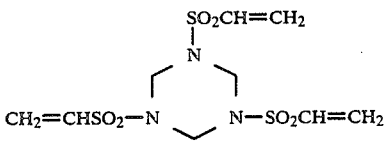

H-11

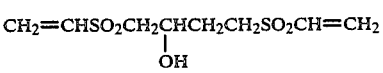

H-12

-continued $CH_2{=}CHSO_2CH_2CONHCH_2CH_2NHCOCH_2SO_2CH{=}CH_2$ H-13

$(CH_2{=}CHSO_2CH_2CH_2O{-}CH_2CH_2)_2SO_2$ H-14

$[(CH_2{=}CHSO_2CH_2)_3CCH_2SO_2CH_2CH_2]_2N{-}CH_2CH_2SO_3K$ H-15

H-16

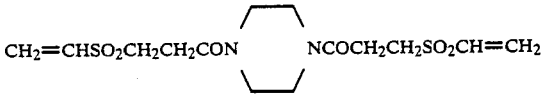

$(CH_2{=}CHSO_2CH_2)_2C(CH_2SO_2CH_2CH_2OSO_3Na)_2$ H-17

H-18

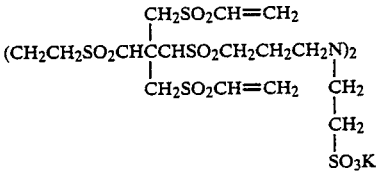

H-19

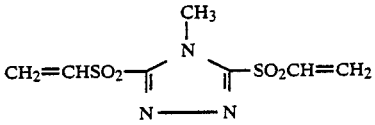

$(CH_2{=}CHSO_2CH_2)_4C$ H-20

$CO(CH_2CH_2SO_2CH{=}CH_2)_2$ H-21

$NH(CH_2CH_2SO_2CH{=}CH_2)_2$ H-22

H-23

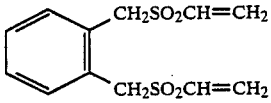

H-24

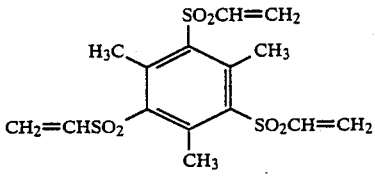

H-25

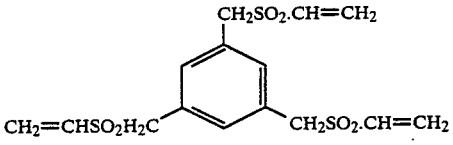

H-26

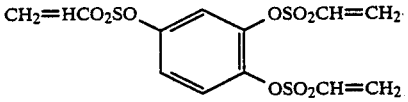

H-27

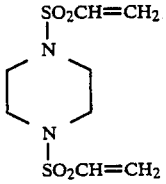

$CH_3C(CH_2OCH_2SO_2CH{=}CH_2)_3$ H-28

$N(CH_2CH_2OCH_2SO_2CH{=}CH_2)_3$ H-29

$H_{17}C_8{-}C(CH_2SO_2CH{=}CH_2)_3$ H-30

$CH_2{=}CHSO_2CH_2CH(CH_2SO_2CH{=}CH_2)CH_2SO_2CH{=}CH_2$ H-31

$BrH_2C{-}C(CH_2SO_2CH{=}CH_2)_3$ H-32

$(CH_2{=}CHSO_2CH_2)_2CH{-}CH(CH_2SO_2CH{=}CH_2)_2$ H-33

$(CH_2{=}CHSO_2CH_2)_3C{-}CH_2OCH_2C(CH_2SO_2CH{=}CH_2)_3$ H-34

$(CH_2{=}CHSO_2CH_2)_3C{-}CH_2SO_2CH_2CH_2Cl$ H-35

$SO_2CH{=}CH_2$ H-36

$CH_2{=}HCO_2S$ $SO_2CH{=}CH_2$

-continued $CH_2=HCO_2S$ $SO_2CH=CH_2$
$SO_2CH=CH_2$
$COCH_2CH_2SO_2CH=CH_2$ H-37

$CH_2=CHSO_2CH_2CH_2CO-N$ $N-COCH_2SO_2CH=CH_2$
$CH_2=CHSO_2(CH_2)_4SO_2CH=CH_2$ H-38

An addition amount of the hardener used in the invention is usually 0.01 to 20% by weight of a hydrophilic colloid, and preferably 0.05 to 10% by weight.

In the light-sensitive material of the invention, the layers hardened by the preceding hardener are not particularly limited, and the agent may be used not only for a silver halide emulsion layer but also for any gelatin-containing photographic component layers such as an antihalation layer, a backing layer, a filter layer, an intermediate layer, and a protective layer.

The hardener of the invention may be used alone or in combination with the other hardeners of the invention or conventional ones.

The examples of the vinylsulfone type hardeners used in the invention include aromatic compounds described in West German Patent No. 1,100,942; alkyl compounds combined with hetero atoms, described in Japanese Patent Examined Publication Nos. 29622/1969 and 25373/1972; sulfonamides and esters described in Japanese Patent Examined Publication No. 8736/1972; 1,3,5-tris[(β-vinylsulfonyl)-propionyl]-hexahydro-s-triazine described in Japanese Patent Publication Open to Public Inspection (hereinafter referred to as Japanese Patent O.P.I. Publication) No. 24435/1974; alkyl compounds described in Japanese Patent O.P.I. Publication No. 44164/1976.

In addition to the above exemplified compounds, the vinylsulfone type hardeners applicable to this invention also include the compounds which are prepared by reaction of a compound having at least three vinylsulfone groups in a molecular structure with a compound having the groups capable of reacting with a vinylsulfone group, and a water-soluble group, such as diethanolamine, thioglycolic acid, sodium sarcosine. and sodium taurine.

The emulsion of the invention may be prepared either via or not via a seed emulsion. The emulsions prepared via the seed emulsions of the invention using a high-molecular flocculant are all equivalent to the emulsion of the invention, provided that a seed emulsion used for preparing an emulsion of the invention may not necessarily be an emulsion of this invention. The emulsion of the invention is prepared preferably by growing the seed emulsion of the invention and carrying out desalting under at least one of the preceding Conditions (1) to (3) using a high-molecular flocculant.

The silver halide composition of the emulsion of the invention is discretional and includes silver chloride, silver bromide, silver iodide, silver bromochloride silver bromoiodide, silver chloroiodide, silver bromochloroiodide and mixtures thereof. Particularly, silver bromoiodide is preferably used. A silver iodide content of silver bromoiodide is preferably not more than 10 mole %, preferbly not more than 6 mole % and further more preferably 0.2 to 6 mole % in terms of an average silver iodide content of the whole silver halide grains.

In this instance, the silver iodide concentrates preferably inside a grain; silver iodide of at least 20 mole % is preferably present locally in a grain.

The silver halide grains contained in the emulsion of the invention may be either multilayered or tabular.

The tabular silver halide grain can be obtained by adding a certain chemical such as a thioether to the silver halide grain while growing. Details of the tabular grain are disclosed in Japanese Patent O.P.I. Publication Nos. 113,927/1983, 113,928/1983, 105,636/1984 and 147,727/1985.

The multilayered grain is a so-called core/shell type grain in which a shell of silver halide is provided on an inner core. The shell may be comprised of a single stratum or of two or more strata and preferably of not more than 5 strata.

The silver halide used to constitute the core and shell is preferably silver bromide, silver bromoiodide or silver iodide, each of which may be mixed with silver chloride of a slight amount (preferably not more than 10 mole %, and more preferably not more than 5 mole %).

Preferably is used a silver iodobromide grain composed of the strata having the different silver iodide contents.

The outmost stratum of the shell consists substantially of preferably silver bromide or silver bromoiodide having a silver iodide content of not more than 10%, and may contain a chlorine atom of less than several percent.

The emulsion of the invention can be prepared by the conventional methods.

An average size of a silver halide grain is preferably 0.1 to 3 μm, and more preferably 0.3 to 2 μm.

The emulsion of the invention may be either monodispersed or polydispersed.

The emulsion of the invention may be chemically sensitized by a conventional sulfur sensitization, a reduction sensitization, a noble-metal sensitization method or in combination thereof. The examples of a chemical sensitizer include a sulfur sensitizer such as allyl thiocarbamide, thiourea, thiosulfate, thioether, and cystine; a noble metal sensitizer such as potassium chloroaurate, aurous thiosulfate, and potassium chloropalladate; and a reduction sensitizers such as stannous chloride, phenyl hydrazine, and reductone.

The emulsion of the invention and the other emulsions may be spectrally sensitized by a cyanine dye and the like. The sensitizing dyes may be used alone or in combination; the sensitizing dyes are often used in combination particularly for supersensitization.

Various kinds of hydrophilic colloids are used for the emulsions as a binder.

The examples of the colloid include the hydrophilic colloids conventionally used in the photographic art, such as gelatin, colloidal albumin, polysaccharide, a cellulose derivative, a synthetic resin, a polyvinyl compound including a polyvinyl alcohol derivative, and polyacrylamide.

Further, may be added thickeners described in U.S. Pat. No. 3,167,410 and Belgian Patent No. 558,143; gelatin plasticizers such as polyols described in U.S. Pat. No. 2,960,404, Japanese Patent Examined Publication No. 4939/1968 and Japanese Patent O.P.I. Publication No. 63715/1973; latexes described in U.S. Pat. No. 766,979, French Patent No. 1,395,544 and Japanese Patent Examined Publication No. 43125/1973; and matting agents described in British Patent No. 1,221,980.

Into the Component layers of the light-sensitive material of the invention may be incorporated coating aids such as saponin or sulfosuccinic acid type surface active agents described in British Patent No. 548,532 and Japanese Patent O.P.I. Publication No. 89630/1972, and anionic surface active agents described in Japanese Patent Examined Publication No. 18166/1968, U.S. Pat. No. 3,514,293, French Patent No. 2,025,688 and Japanese Patent Examined Publication No. 10247/1968.

To the emulsion layers may be added various compounds to prevent the light-sensitive material from sensitivity deterioration and fogging. Such compounds include many conventional compounds such as heterocyclic compounds, mercury-containing compounds, mercapto compounds and metallic salts, as well as 4-hydroxy-6-methyl-1,3,3a,7-tetrazaindene, 3-methylbenzothiazole, and 1-phenyl-3-mercaptotetrazole.

Any conventional materials may be used as a support for the light-sensitive material of the invention.

EXAMPLES

The examples of the present invention are detailed below. It goes without saying that this invention is not limited to the following examples.

EXAMPLE 1

Two different seed emulsions T-1 and T-2 were prepared in the following manner. The seed emulsion T-1 (comparative emulsion) was grown to obtain the emulsions (a comparative emulsion and an emulsion of the invention), and the seed emulsion T-2 (an emulsion of the invention) to obtain an emulsion of the invention. Then, these emulsions were desalted under the conditions specified in Table 1 to prepare the emulsions for coating.

I. Preparation of emulsions

A. Preparation of seed emulsions T-1 and T-2

A dispersion containing monodispersed cubic silver bromoiodide grains having an average grain size of 0.3 μm and an average AgI content of 2 mole % was prepared at 60° C. controlling pAg and pH at 8 and 2.0, respectively, by a double jet method. This dispersion was divided into two parts, which were then separately desalted as follows to obtain the seed emulsions T-1 and T-2.

Desalting method for T-1

To one divided dispersion were added at 40° C. a condensation product (comparative flocculant) of sodium naphthalenesulfonate and formalin, and magnesium sulfate $MgSO_4$ in the amounts of 15 g per mole of AgX and 60 g per mole of AgX, respectively. After the suspension was stirred for 3 minutes and then allowed to stand for a while, the excessive salts were removed by decantation. Then, it was dispersed in 2.1 liters of pure water per mole of AgX at 40° C. Further, 30 g of $MgSO_4$ per mole of AgX were added to it, and after stirring for 3 minutes, the dispersion was allowed to stand for a while to be subjected to decantation. Gelatin was added and the emulsion was dispersed stirring further for 20 minutes at 55° C. to obtain T-1.

Comparative Flocculant

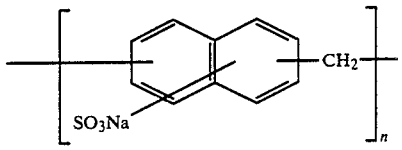

n: 4~6

Desalting method for T-2 (desalting method for obtaining the emulsion of the invention)

To another divided dispersion were added at 60° C. 38 g of an exemplified gelatin flocculant G-3, and the suspension was stirred for 3 minutes. After adding 0.13 g of potassium hydroxide KOH per mole of AgX to adjust pH to 4.0, the suspension was allowed to stand for a while to be subjected to decantation. Further, 2.1 liters of pure water per mole of AgX maintained at 40° C. and then 0.25 g of KOH per mole of AgX were added to adjust pH to 5.8, and the suspension was stirred for 5 minutes. Then, 1.5 ml of nitric acid $HNO_3$ (1.7N) per mole of AgX were added to adjust pH to 4.3, and the suspension was allowed to stand to be subjected to decantation. Further, gelatin and 0.2 g Of KOH per mole of AgX were added to it to adjust pH to 5.8, and it was redispersed to obtain T-2.

The seed emulsion T-2 is the emulsion of the invention, so that all emulsions which are obtained therefrom are emulsions of the invention.

B. Growth from the seed emulsions

The above seed emulsions T-1 and T-2 were grown in the following manner. Seed emulsion T-1 was dispersed in 8.5 liters of a protective colloid solution kept at 40° C. and containing protective gelatin and ammonia as needed, and then pH of the emulsion was adjusted by acetic acid. To this emulsion were added by a double jet method a 3.2N ammoniacal silver ion aqueous solution and an aqueous solution containing potassium bromide and potassium iodide. A silver iodide content and a crystal habit were controlled by pH and pAg; a stratum having an AgI content of 35 mole % was formed with pH and pAg controlled at 9.7 and 7.3, respectively; next, the grains were grown up to 95% with pH changed stepwise from 8 to 9 and with pAg kept at 9.0; then, a potassium bromide solution was added over 8 minutes to adjust pAg to 11.0, and three minutes after addition of the potassium bromide solution, mixing was completed. Afterwards, pH was adjusted to 6.0 by acetic acid. This emulsion was of monodispersed grains whose average grain size was 0.53 μm, and an average silver iodide content was approximately 2 mole %. This emulsion was then divided into two parts, and the respective parts were subjected to removal of the excessive soluble salts by the following desalting methods (1) and (2) under the conditions of a temperature, pH, pAg and emulsion concentration as given in Table-1.

Desalting method (1)

a. To one divided emulsion kept at 40° C. were added 5.5 g of Comparative Flocculant I per mole of AgX and 8.5 g of $MgSO_4$ per mole of AgX, and after stirring for 3 minutes, the suspension was allowed to stand for a while to be subjected to decantation.

b. After the suspension was dispersed in 1.8 liters of pure water per mole of AgX at 40° C., were added thereto 20 g of $MgSO_4$ per mole of AgX, and it was stirred for 3 minutes to be subjected to decantation after standing for a while.

c. The above two processes were repeated once again.

d. Fifteen grams of gelatin per mole of AgX and water were added to make the whole quantity 450 ml per mole of AgX, and the emulsion was dispersed stirring further for 20 minutes at 55° C.

Desalting method (2)

a. To another divided emulsion were added 50 g of an exemplified gelatin flocculant G-3 per mole of AgX under the conditions of a temperature, pH, pAg and an emulsion concentrations as given in Table-1, and 110 ml of 56 wt % acetic acid per mole of AgX was added to adjust pH to 5.0. The suspension was allowed to stand for a while to be subjected to decantation.

b. The suspension was dispersed in pure water of 1.8 liter per mole of AgX at 40° C., and then 6.8 g of KOH per mole of AgX was added to adjust pH to 6.0. After dispersing well, 70 ml of 56 wt % acetic acid per mole of AgX were added to adjust pH to 4.5, and the suspension was allowed to stand for a while to be subjected to decantation.

c. The above two processes were repeated once again.

d. Fifteen grams of gelatin per mole of AgX, 1 g of KOH per mole of AgX, and water were added to the emulsion to make the whole quantity 450 ml per mole of AgX.

The desalting method (2) is for obtaining an emulsion of the invention.

The seed emulsion T-2 was grown as well and desalted by the aforementioned two desalting methods to prepare the emulsions.

II. Sample preparation and evaluation

Sample preparation

The above emulsions were subjected to gold-sulfur sensitization with ammonium thiocyanate, chloroauric acid and hypo.

After completion of the chemical sensitization, 4-hydroxy-6-methyl-1,3,3a,7-tetrazaindene was added to the emulsion, and then the emulsion was spectrally sensitized by adding 150 mg of potassium iodide, 300 mg and 15 mg of the following spectral sensitizers I and II, each per mole of AgX.

Spectral sensitizer I

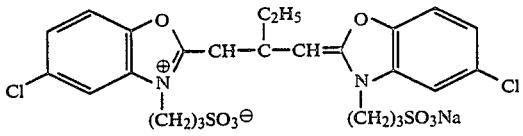

Spectral Sensitizer II

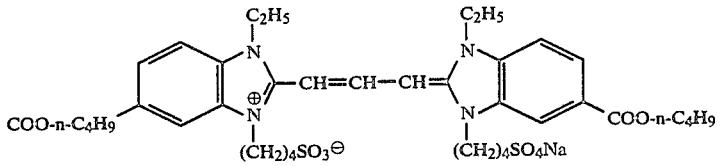

Further, the following additives per mole of silver halide were added to the above emulsion.

| | |
|---|---|
| t-Butyl catechol | 400 mg |
| Polyvinyl pyrrolidone (molecular weight 10000) | 1.0 g |
| Styrene-maleic anhydride copolymer | 2.5 g |
| Trimethylol propane | 10 g |
| Diethylene glycol | 5 g |
| Nitrophenyl-triphenyl-phosphonium chloride | 50 mg |
| Ammonium 1,3-dihydroxybenzene-4-sulfonate | 4 g |
| Sodium 2-mercaptobenzimidazole-5-sulfonate | 15 mg |
| 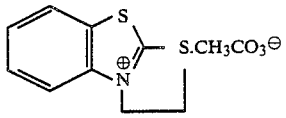 | 70 mg |
| 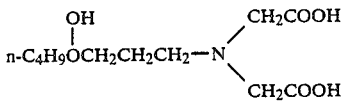 | 1 g |
| 1,1-Dimethylol-1-bromo-1-nitromethane | 10 mg |
| Also, to a protective coating were added the following compounds per gram of gelatin. | |
| 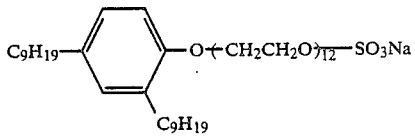 | 10 mg |
| 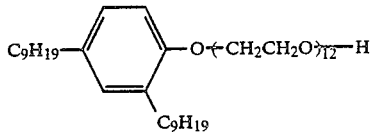 | 2 mg |
| $CH_2—COO(CH_2)_9CH_3$ / $CHCOO(CH_2)_2CH(CH_3)_2$ / $SO_3Na$ | 7 mg |
| $C_9F_{19}—O—(CH_2CH_2O)_{10}—CH_2CH_2OH$ | 2 mg |
| $C_8F_{17}SO_3K$ | 3 mg |

-continued

| | |
|---|---|
| 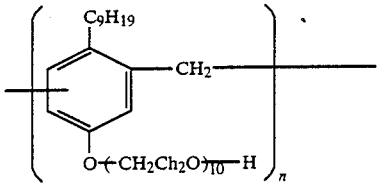 | 15 mg |
| Polymethyl methacrylate having an average particle size of 5 μm (matting agent) | 7 mg |
| Colloidal silica (average particle size 0.013 μm) | 70 mg |
| $(CHO)_2$ (40% aqueous solution) | 1.5 ml |
| HCHO (35% aqueous solution) | 2 ml |
| Sodium 2,4-dichloro-6-hydroxy-1,3,5-triazine (2% aqueous solutuon) | 10 ml |

A subbing layer was coated in the following manner: On a support was coated a subbing solution which was prepared by dispersing a copolymer comprised of glycidyl methacrylate 50 wt %, methyl methacrylate 10 wt % and butyl methacrylate 40 wt % in water in a concentration of 10 wt %.

A coating emulsion and a protective coating solution were coated simultaneously on both sides of a support subbed in the preceding manner in the order of silver halide emulsion layer and a protective layer from the support side. and then dried to prepare Samples No. 1 to 36 of a silver halide photographic film as shown in Table 1.

A coated amount of gelatin of an unprocessed film was 3.10 g/m$^2$ per side of the support.

Evaluation of samples

(1) Sensitometry

A sample was sandwiched in a fluorescent intensifying screen KS for radiograph, manufactured by KONICA Corporation, and was exposed to X-ray through a penetrometer type B, manufactured by KONICA Medical Corporation. Then, it was processed in a developer XD-90 in 90 seconds with an automatic processor KX-500 manufactured by KONICA Corporation. The sensitivities of the processed samples were evaluated. The sensitivity is expressed by a reciprocal of an exposure necessary for giving a fog +1.0 density, and by a value relative to that of Sample 1, which is set at 100.

(2) Measurement of roller marks

Resistance for roller marks (pressure marks caused by the rollers of an automatic processor) in processing was evaluated as follows: a unexposed sample was processed in an X-ray automatic processor having opposed type rollers with heavily roughened surfaces, and the developed sample was observed visually and classified into five grades:

5: No roller marks,
4: Only a few roller marks,
3: Roller marks to some extent within practicability,
2: A lot of roller marks out of placticability,
1: Heavy roller marks.

The evaluation results are summarized in Table 1.

The compositions of a developer and fixer used in the above processing are as follows:

| | |
|---|---|
| Developer | |
| Potassium sulfite | 68.75 g |
| Sodium hydroxyethylethylenediamine-triacetate | 8 g |
| 1,4-Dihydroxybenzene | 27 g |
| Boric acid | 10 g |
| 5-Methylbenzoimidazole | 0.035 g |
| 1-Phenyl-5-mercaptotetrazole | 0.015 g |
| Sodium metabisulfite | 5.0 g |
| Acetic acid (90%) | 12.8 g |
| Diethylene glycol | 16.0 g |
| 1-Phenyl-3-pyrazolidone | 1.2 g |
| 5-Nitroindazole | 0.14 g |
| 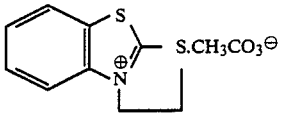 | 0.001 g |
| Glutaraldehyde | 3.08 g |
| Potassium bromide | 4.0 g |
| 5-Methylbenzotriazole | 0.05 g |
| Water was added to make total quantity 1 liter. | |
| pH was adjusted to 10.40 by potassium hydroxide. | |
| Fixer | |
| Ammonium thiosulfate | 140 g |
| Sodium sulfite | 7.3 g |
| Sodium acetate | 15.5 g |
| Aluminum sulfate, deca- to decaoctahydrated | 27.7 g |
| Sulfuric acid (50% by weight solution) | 6.0 g |
| Citric acid | 0.9 g |
| Boric acid | 7.0 g |
| Glacial acetic acid | 5.1 g |
| Disodium ethylenediaminetetraacetate | 5 g |
| Water was added to make total quantity 1 liter. | |
| pH was adjusted to 4.3 by sulfuric acid (50% by weight solution). | |

TABLE 1

| Sample No. | Seed EM | Desalting conditions: Temp. (°C.) | pH | pAg | EM concentration (%) | Desalting method | Fog | Sensitivity | Roller mark resistance |
|---|---|---|---|---|---|---|---|---|---|
| 1 (comp.) | T-1 | 40 | 6.0 | 11.0 | 17 | 1 | 0.05 | 100 | 1 |
| 2 (inv.) | T-1 | 40 | 6.0 | 11.0 | 17 | 2 | 0.03 | 125 | 3 |
| 3 (inv.) | T-2 | 35 | 6.0 | 11.0 | 17 | 2 | 0.04 | 130 | 3 |
| 4 (inv.) | T-2 | 35 | 6.0 | 5.0 | 17 | 2 | 0.04 | 135 | 3 |
| 5 (inv.) | T-1 | 35 | 6.0 | 5.0 | 25 | 2 | 0.04 | 140 | 4 |
| 6 (inv.) | T-1 | 35 | 2.0 | 11.0 | 20 | 2 | 0.03 | 140 | 4 |
| 7 (inv.) | T-2 | 35 | 2.0 | 5.0 | 25 | 2 | 0.03 | 130 | 4 |
| 8 (inv.) | T-2 | 35 | 2.0 | 4.5 | 20 | 2 | 0.03 | 137 | 3 |
| 9 (inv.) | T-1 | 35 | 1.5 | 11.0 | 20 | 2 | 0.03 | 121 | 3 |
| 10 (inv.) | T-2 | 35 | 1.5 | 11.0 | 25 | 2 | 0.02 | 125 | 3 |
| 11 (inv.) | T-2 | 35 | 1.5 | 4.5 | 17 | 2 | 0.02 | 123 | 3 |
| 12 (inv.) | T-2 | 35 | 1.5 | 4.5 | 25 | 2 | 0.03 | 120 | 3 |
| 13 (inv.) | T-2 | 40 | 6.0 | 11.0 | 17 | 1 | 0.02 | 145 | 3 |
| 14 (inv.) | T-2 | 40 | 6.0 | 11.0 | 17 | 2 | 0.02 | 165 | 4 |

TABLE 1-continued

| Sample No. | Seed EM | Desalting conditions Temp. (°C.) | pH | pAg | EM concentration (%) | Desalting method | Fog | Sensitivity | Roller mark resistance |
|---|---|---|---|---|---|---|---|---|---|
| 15 (inv.) | T-2 | 40 | 6.0 | 11.0 | 25 | 2 | 0.02 | 150 | 5 |
| 16 (inv.) | T-2 | 40 | 6.0 | 11.0 | 20 | 2 | 0.02 | 152 | 5 |
| 17 (inv.) | T-2 | 40 | 6.0 | 4.5 | 17 | 2 | 0.03 | 147 | 4 |
| 18 (inv.) | T-1 | 40 | 6.0 | 4.5 | 25 | 2 | 0.02 | 149 | 4 |
| 19 (inv.) | T-1 | 40 | 2.0 | 11.0 | 20 | 2 | 0.02 | 170 | 5 |
| 20 (inv.) | T-2 | 40 | 2.0 | 5.0 | 25 | 2 | 0.02 | 175 | 4 |
| 21 (inv.) | T-2 | 40 | 2.0 | 4.5 | 17 | 2 | 0.02 | 160 | 4 |
| 22 (inv.) | T-1 | 40 | 2.0 | 4.5 | 25 | 2 | 0.03 | 155 | 4 |
| 23 (inv.) | T-1 | 40 | 1.5 | 11.0 | 20 | 2 | 0.03 | 155 | 4 |
| 24 (inv.) | T-2 | 40 | 1.5 | 5.0 | 17 | 2 | 0.03 | 157 | 4 |
| 25 (inv.) | T-2 | 40 | 1.5 | 5.0 | 25 | 2 | 0.03 | 150 | 4 |
| 26 (inv.) | T-2 | 40 | 1.5 | 4.5 | 20 | 2 | 0.03 | 145 | 4 |
| 27 (inv.) | T-2 | 50 | 6.0 | 11.0 | 17 | 2 | 0.02 | 160 | 5 |
| 28 (inv.) | T-2 | 50 | 6.0 | 11.5 | 20 | 2 | 0.01 | 170 | 5 |
| 29 (inv.) | T-1 | 50 | 6.0 | 4.5 | 17 | 2 | 0.01 | 160 | 5 |
| 30 (inv.) | T-1 | 50 | 6.0 | 4.5 | 25 | 2 | 0.01 | 165 | 4 |
| 31 (inv.) | T-1 | 50 | 2.0 | 11.0 | 25 | 2 | 0.01 | 175 | 5 |
| 32 (inv.) | T-2 | 50 | 2.0 | 5.0 | 20 | 2 | 0.02 | 172 | 5 |
| 33 (inv.) | T-2 | 50 | 2.0 | 4.5 | 20 | 2 | 0.02 | 167 | 4 |
| 34 (inv.) | T-2 | 50 | 1.5 | 11.0 | 17 | 2 | 0.01 | 160 | 5 |
| 35 (inv.) | T-2 | 50 | 1.5 | 5.0 | 20 | 2 | 0.01 | 165 | 5 |
| 36 (inv.) | T-2 | 50 | 1.5 | 4.5 | 20 | 2 | 0.02 | 157 | 4 |

As is apparent from Table 1, Samples 2 to 36 of the invention have high sensitivities and improved roller mark resistance.

EXAMPLE 2

I. Preparation of monodispersed emulsions from seed emulsion

An emulsion prepared from the seed emulsion T-1 in the same manner as in Example 1 was desalted by the desalting method (1) to obtain Emulsion II-1. The same emulsion was desalted as well by the desalting method (2) to obtain Emulsion II-2.

Further, an emulsion prepared from the seed emulsion T-2 as well was desalted by the desalting methods (1) and (2) to obtain Emulsions II-3 and II-4, respectively.

II. Preparation of monodispersed emulsions without using seed emulsions

An emulsion containing monodispersed silver bromoiodide having an average grain size of 0.53 μm and an average AgI content of 2 mole % was prepared in the same manner as the seed emulsions subjected to no desalting. This emulsion was divided into two parts, which were desalted by the desalting methods (1) and (2), respectively, to obtain Emulsions II-5 and II-6.

III. Preparation of polydispersed emulsions

By an orderly mixing method, an emulsion was prepared from the following four solutions;

| | |
|---|---|
| Solution A: | |
| Silver nitrate | 100 g |
| Aqueous ammonia (28%) | 78 ml |
| Water was added to make total quantity | 240 ml |
| Solution B: | |
| Osein gelatin | 8 g |
| Potassium bromide | 80 g |
| Potassium iodide | 1.3 g |
| Water was added to make total quantiy | 550 ml |
| Solution C: | |
| Aqueous ammonia | 6 ml |
| Glacial acetic acid | 10 ml |
| Water | 34 ml |

-continued

| | |
|---|---|
| Solution D: | |
| Glacial acetic acid | 226 ml |
| Water was added to make total quantity | 400 ml |

Solution B and Solution C put in a reactor were stirred and mixed by a propeller-type stirrer at 300 r.p.m at 55° C.

Subsequently, Solution A was divided into 80 ml and 160 ml (volume ratio 1:2) and 80 ml were added to the reactor in one minute, followed by stirring for 10 minutes. Further, remaining 160 ml were added to it in 10 minutes and stirred for 30 minutes. Then, Solution D was added to adjust pH of the emulsion to 0.6.

The above emulsion was divided into two parts, which were desalted by the desalting methods (1) and (2), respectively, to prepare Emulsions II-7 and II-8.

IV. Preparation of emulsions containing tabular grains

By a double jet method, 30 ml of a silver nitrate solution (0.88 mole %) and 30 ml of a KI/KBr solution (a mole ratio 3.5:96.5, 0.88 mole/liter) were added stirring at 70° C. to a solution in which 10.5 g of KBr, 10 ml of a 0.5 wt % aqueous solution of thioether, $HO(CH_2)_2S(CH_2)_2S(CH_2)_2OH$, and 30 g of gelatin were dissolved in one liter of water. After addition, this emulsion was cooled to 40° C., and then divided into two parts. To one part were added a comparative flocculant I and $MgSO_4$ each in an amount of 24.6 g per mole of AgX, and pH was adjusted to 4.0. Then, the emulsion was desalted, and 15 g gelatin per mole of AgX was added to prepare Emulsion II-9.

The other part of the emulsion was desalted by the desalting method (2) to prepare Emulsion II-10.

The above ten emulsions were chemically and spectrally sensitized in the same manner as in Example 1.

To these emulsions were added as shown in Table-2 the hardeners of the invention and the comparative hardener as well as the same additives as those in Example 1 to prepare the 29 emulsions for coating.

Further, a gelatin solution was prepared in the same manner as Example 1, except that a 40% $(CHO)_2$ solution, a 35% HCHO solution and a 2% solution of sodium 2,4-dichloro-6-hydroxy-1,3,5-triazine solution were removed from the protective coating solution prepared in Example 1.

The above two coating solutions were coated on a polyester film support in the same manner as in Example 1 to prepare Samples No. 37 to 65 of a silver halide light-sensitive photographic material.

An amount of gelatin coated on these samples was 3.10 g/m$^2$ per side of the film, and the total coating weight of silver on both sides of the film was 4.5 g/m$^2$.

(1) Sensitometry

Both sides of a film were exposed in an exposure of 3.2 cdms for 0.1 second to a standard light B described in p. 39 of New Data Book on Illumination, 1st ed., Vol. 2, compiled by the Illumination Society, Japan.

The exposed sample was processed in a XD-SR developer solution in 45 seconds with an SRX-501 Automatic Processor manufactured by KONICA Corporation. A sensitivity of each sample was measured in the same manner as in Example 1, and expressed by a relative value to that of Comparative Sample 37, which was set at 100.

(2) Measurement of roller marks

The roller marks were measured in the same manner as in Example I.

(3) Developed silver tone

A sample of 30 cm×30 cm was exposed up to 1.0 of a transmission density after developing, and then processed in 45 seconds including developing, fixing, washing and up to drying, in a Developer Xd-SR (a product of KONICA Corporation) at 35° C. and a Fixer XF-SR (a product of the same) with automatic processor SR-501, manufactured by KONICA Corporation.

After standing for 7 days under the condition of 50° C. and 80% RH, the sample was placed on a viewing lantern to visually observe a silver tone with transmission light.

The criteria for evaluation are as follows;

A: Black,

B: Slightly reddish black,

C: Reddish black,

D: Black tinged slightly with reddish yellow,

E: Black tinged with reddish yellow.

The results are summerized in Table 2.

TABLE 2

| Sample No. | EM No. | Hardener Type* | Hardener Added amt. (mg/g gel.) | Sensitivity | Roller mark resistance | Silver tone |
|---|---|---|---|---|---|---|
| 37 (comp.) | II-1 | A | 24 | 100 | 1 | C |
| 38 (comp.) | II-1 | H-1 | 36 | 100 | 2 | C |
| 39 (comp.) | II-1 | H-10 | 30 | 100 | 2 | C |
| 40 (comp.) | II-2 | A | 24 | 95 | 4 | C |
| 41 (inv.) | II-2 | H-1 | 36 | 95 | 4 | A |
| 42 (comp.) | II-3 | A | 24 | 95 | 2 | C |
| 43 (comp.) | II-3 | H-1 | 36 | 95 | 2 | B |
| 44 (comp.) | II-4 | A | 24 | 95 | 2 | C |
| 45 (inv.) | II-4 | H-1 | 36 | 95 | 5 | A |
| 46 (inv.) | II-4 | H-10 | 36 | 95 | 5 | A |
| 47 (comp.) | II-5 | | 24 | 90 | 2 | B |
| 48 (comp.) | II-5 | H-1 | 36 | 90 | 2 | B |
| 49 (comp.) | II-6 | A | 24 | 80 | 4 | B |
| 50 (inv.) | II-6 | H-1 | 36 | 85 | 4 | A |
| 51 (comp.) | II-7 | A | 24 | 80 | 2 | C |
| 52 (comp.) | II-7 | H-1 | 36 | 80 | 2 | C |
| 53 (comp.) | II-8 | A | 24 | 80 | 4 | C |
| 54 (inv.) | II-8 | H-1 | 36 | 85 | 4 | A |
| 55 (comp.) | II-9 | A | 24 | 100 | 2 | B |
| 56 (comp.) | II-9 | H-1 | 36 | 100 | 2 | B |
| 57 (comp.) | II-9 | H-10 | 30 | 100 | 2 | B |
| 58 (comp.) | II-10 | A | 24 | 90 | 4 | B |
| 59 (inv.) | II-10 | H-12 | 30 | 95 | 5 | A |
| 60 (inv.) | II-10 | H-1 | 36 | 95 | 5 | A |
| 61 (inv.) | II-10 | H-10 | 30 | 95 | 5 | A |
| 62 (inv.) | II-10 | H-18 | 40 | 95 | 5 | A |
| 63 (inv.) | II-10 | H-21 | 34 | 95 | 5 | A |
| 64 (inv.) | II-10 | H-12 | 15 | 95 | 5 | A |
| | | H-1 | 20 | | | |
| 65 (inv.) | II-10 | H-20 | 20 | 95 | 5 | A |
| | | H-18 | 22 | | | |

Note: *'A' in the Type of Hardener: Comparative hardener $(CHO)_2$.

As is apparent from Table 2, Samples 41, 45, 46, 50, 54, and 59 through 65, which were prepared using Emulsions II-2, II-4, II-6, II-8 and II-10, each desalted by the method of the invention and hardened by the vinylsulfone type hardeners of the invention, comprise less desensitization and roller marks, and can provide black images of more excellent silver tone than those of the comparative samples.

What is claimed is:

1. A silver halide light sensitive photographic material having a support and, provided thereon, hydropholic colloidal layers including at least one silver halide light-sensitive emulsion layer, said silver halide emulsion layer comprising a silver halide emulsion (I) prepared by adding a high molecular weight floculant to silver halide emulsion (II) under at least one of Conditions (1) through (3):

Condition (1): a temperature of said silver halide emulsion (II) is at least 30° C. when adding said flocculant:

Condition (2): pH and pAg of said silver halide emulsion (II) are at least 2 and at least 5, respectively, when adding said flocculant; and Condition (3): a concentration of silver halide grains contained in said silver halide emulsion (II) is at least 20% by weight when adding said flocculant;

said silver halide emulsion (II) being prepared by adding a water-soluble silver salt solution and a water-soluble halide solution to a protective colloid solution, said hydropholic colloidal layers being hardened with a vinyl sulfone hardener of Formula (II):

$$[CH_2{=}CHSO_2{-}\underset{\underset{R}{|}}{CH}{-}]_m{-}_n Z \qquad [II]$$

wherein R represents a hydrogen atom or a lower alkyl group; Z represents an n-valent group having at least one of oxygen, nitrogen, and sulfur; m is 1 or 2; and n is 2 or 3, and wherein said flocculant is a modified gelatine flocculant having amino groups of which at least 50% are substituted.

2. The photographic material of claim 1, wherein said temperature in Condition (1) is not lower than 30° C. and not higher than 60° C.

3. The photographic material of claim 1, wherein said pH in Condition (2) is not lower than 2 and not higher than 6, and pAg is not lower than 10 and not higher than 12.

4. The photographic material of claim 1, wherein said concentration in Condition (3) is not less than 20% by weight and not more than 50% by weight.

5. The photographic material of claim 1, wherein said high-molecular flocculant is represented by Formula (I);

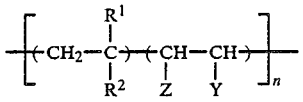

Formula (I)

wherein $R_1$ and $R_2$ represent independently an alkyl group having 1 to 8 carbon atoms; Z and Y represent independently —COOM, —$COOR_3$ and —$CONR_4R_5$; M represents a hydrogen atom, an alkali metal or an ammonium group; $R_3$ represents an alkyl group having 1 to 20 carbon atoms, or an aryl group; $R_4$ and $R_5$ represent independently a hydrogen atom, an alkyl group having 1 to 20 carbon atoms, and an aryl group, provided that $R_4$ and $R_5$ may be combined with each other to form a heterocyclic ring; n represents an integer of 10 to $10^4$.

6. The photographic material of claim 5, wherein a molecular weight of said high-molecular flocculant is $10^3$ to $10^8$.

7. The photographic material of claim 6, wherein said molecular weight is $3\times10^3$ to $2\times10^5$.

8. The photographic material of claim 5, wherein an addition amount of said high-molecular flocculant is 1/50 to ¼ in a weight ratio to the protective colloid contained in the silver halide emulsion.

9. The photographic material of claim 8, wherein said addition amount is 1/40 to 1/10 in the weight ratio to the protective colloid.

10. The photographic material of claim 1, wherein an addition amount of said modified gelatin flocculant is 3/10 to 10 in a weight ratio to the protective colloid contained in the silver halide emulsion.

11. The photographic material of claim 10, wherein said addition amount is 1 to 5 in the weight ratio to the protective colloid.

12. The photographic material of claim 1, wherein an addition amount of said vinyl sulfone type hardener is 0.01 to 20% by weight of the protective colloid.

13. The photographic material of claim 12, wherein said addition amount is 0.05 to 10% by weight.

* * * * *